US010918570B1

(12) United States Patent
Hincher, Sr.

(10) Patent No.: US 10,918,570 B1
(45) Date of Patent: Feb. 16, 2021

(54) MEDICATION CONTAINER INFORMATION CONCEALMENT AND TRACKING SYSTEM

(71) Applicant: William M. Hincher, Sr., Freehold, NJ (US)

(72) Inventor: William M. Hincher, Sr., Freehold, NJ (US)

( * ) Notice: Subject to any disclaimer, the term of this patent is extended or adjusted under 35 U.S.C. 154(b) by 112 days.

(21) Appl. No.: 16/252,361

(22) Filed: Jan. 18, 2019

(51) Int. Cl.

| | |
|---|---|
| ***G09F 3/00*** | (2006.01) |
| ***G09F 3/04*** | (2006.01) |
| ***A61J 1/00*** | (2006.01) |
| *G09F 3/02* | (2006.01) |

(52) U.S. Cl.
CPC ..... *A61J 1/00* (2013.01); *G09F 3/00* (2013.01); *G09F 3/04* (2013.01); *A61J 2205/30* (2013.01); *G09F 2003/0273* (2013.01)

(58) Field of Classification Search
CPC ..... G09F 3/00; G09F 3/04; G09F 2003/0273; A61J 1/00
USPC ..... 40/310; 283/901
See application file for complete search history.

(56) References Cited

U.S. PATENT DOCUMENTS

| | | | | |
|---|---|---|---|---|
| 6,941,689 | B1 * | 9/2005 | Seidl | G09F 3/0289 40/310 |
| 8,037,628 | B2 * | 10/2011 | Kaufman | G09F 3/0289 40/310 |
| 2003/0205897 | A1 * | 11/2003 | Kaufman | B42D 15/00 283/117 |
| 2004/0188998 | A1 * | 9/2004 | Henthorn | A61J 7/04 283/115 |
| 2007/0043530 | A1 | 2/2007 | O'Rourke | |
| 2008/0150275 | A1 * | 6/2008 | Raistrick | G09F 3/0288 283/81 |
| 2011/0220713 | A1 * | 9/2011 | Cloninger | G09F 3/0288 235/375 |
| 2013/0026056 | A1 | 1/2013 | Key | |

FOREIGN PATENT DOCUMENTS

| | | | | |
|---|---|---|---|---|
| GB | 2299568 A | | 10/1996 | |
| GB | 2311273 A | * | 9/1997 | G09F 3/10 |
| WO | 2003038783 A2 | | 5/2003 | |

OTHER PUBLICATIONS

Stuart L. Segelnick, DDC, MS; Mea A. Weinberg, DMD, MSD, RPH; Basic Pharmacology: Part II—Pharmacotherapeutic Issues, Drug Regulations, and Prescription Writing—Required Elements of a Legal Prescription; downloaded from URL: https://www.dentalcare.com/en-us/professional-education/ce-courses/ce5061/required-elements-of-a-legal-prescription on Nov. 21, 2018; 4 pages.

* cited by examiner

*Primary Examiner* — Kyle R Grabowski
(74) *Attorney, Agent, or Firm* — Hard IP LLC

(57) ABSTRACT

A medication container information concealment system includes a privacy label including a first side and a second side, a backing, and a tabular insert. The backing is configured to be peeled off of the second side and is detachably adhered to the second side. The tabular insert is detachably coupled to the second side via a perforated tab. The tabular insert includes tracking information. In response to a peeling off of the backing from the second side, an entirety of the second side is configured to wrap around and permanently affix to an outer surface of a container. The privacy label is configured to conceal information remaining on the outer surface of the container, leaving a portion of the first side exposed outwardly.

7 Claims, 6 Drawing Sheets

600

| | | |
|---|---|---|
| 602 Heading | Prescriber's Name, Address, and Telephone Number<br><br>Date_____<br>Patient's name_____ Gender_____ Age_____ DOB_____<br>Address_____ Phone number_____ | |
| 604 Body | $R_X$<br>Name, strength or concentration of the drug<br>Disp: Quantity of the drug to be dispensed<br>Sig: Directions for the patient | |
| 606 Closure | Refill____times<br>Generic substitution allowed: Y or N<br>Other instructions:<br>_____ | Prescriber's signature<br>_____<br><br>DEA#_____ |

FIG. 6

MEDICATION CONTAINER INFORMATION CONCEALMENT AND TRACKING SYSTEM

FIELD

This disclosure relates generally to a medication container information concealment and tracking system, and, more particularly, to a medication container information concealment and tracking system that allows consumers to track prescription medication usage, become aware of when a prescription medication refill is required, and permanently conceal private information provided on a prescription medication container prior to disposal.

BACKGROUND

Prescription medication is intended for personal use, and many individuals do not want others to know what prescriptions they use or how regularly. In addition to private medical information, prescription medication containers (i.e., pill bottles) also maintain other personal or private information, such as addresses or phone numbers. Private information and data maintained on the outside of a prescription medication container may be seen or collected by an individual other than the prescription holder, such that some prescription containers may be pulled from the trash and private information may be collected from the prescription label. When unauthorized users obtain such private information, the users can use such information maliciously. For example, if an unauthorized user locates the private information of a user who consumed a prescription container of opioids, after the prescription container is discarded in the garbage, the unauthorized user may use the private information to obtain a refill of the opioids which may then be consumed in illegal ways.

Most medication containers include prescription labels that are cumbersome to remove from the containers prior to disposal. Users may not be able to peel off the prescription label or properly conceal private information contained on the prescription label, even though pharmacists may suggest removal or redaction of private information prior to disposal of the containers.

Furthermore, some users find it difficult to keep track of medication usage, especially when medication is consumed multiple times daily. Administering proper doses may be a matter of life and death for many prescription holders. It may be easy to forget whether medication has been taken or not, and often times this may lead to an overdosing or even a missing of a dose. Users may utilize charts (i.e., calendar or tables on a piece of paper external to the medication container) and track dosage intake, but the charts can lead to clutter, confusion, or if the chart is not in the vicinity of the user when he/she is consuming the medication, the user may forget to mark the chart accordingly.

SUMMARY

In accordance with an implementation, a medication container information concealment system includes a privacy label including a first side and a second side, a backing, and a tabular insert. The backing is configured to be peeled off of the second side and is detachably adhered to the second side. The tabular insert is detachably coupled to the second side via a perforated tab. The tabular insert includes tracking information. In response to a peeling off of the backing from the second side, an entirety of the second side is configured to wrap around and permanently affix to an outer surface of a container. The privacy label is configured to conceal information remaining on the outer surface of the container, leaving a portion of the first side exposed outwardly.

In another implementation, a medication container information concealment and medication tracking system includes a privacy label and multiple tabular inserts. The privacy label is configured to wrap around a perimeter of a container and conceal private information contained on the container. A tab of the privacy label is adhered to the container. The privacy label includes a first side and a second side. The privacy label is configured to unwrap in part from the container and entirely rewrap around an outer surface of the container and permanently affix to the container via an adhesive applied to the second side. The multiple tabular inserts are detachably coupled to the privacy label via respective perforated tabs.

These and other advantages of the present disclosure will be apparent to those of ordinary skill in the art by reference to the following detailed description and the accompanying drawings.

BRIEF DESCRIPTION OF THE DRAWINGS

The implementations of the disclosure are illustrated by way of examples and not limitation in the figures of the accompanying drawings, in which like references indicate similar elements and in which:

FIG. 6 depicts an exemplary prescription label.

Other features of the present implementations will be apparent from the accompanying drawings and from the detailed description that follows.

DETAILED DESCRIPTION

Currently, prescription medication containers displaying private information may be discarded without removal or redaction of the private information, as removal or redaction of the prescription label containing private information is often cumbersome and time consuming (and sometimes, it is not possible for a patient to remove the prescription label or otherwise redact or conceal the private information contained thereon). In addition, private information may still be visible despite attempts at redaction.

Moreover, patients may lose track of medication intake and usage. Solutions for tracking consumption of medication, such as tracking usage on a chart such as a calendar or a table, help ensure that patients remember when they have consumed medication and how much. However, if the chart is not in the vicinity of the medication, a patient may inadvertently forget to track medication consumption.

The present disclosure solves the problem of exposed private information on medication containers and provides a solution for tracking of medication use. The present disclosure provides a medication container concealment system which offers an integrated solution to address the problems in existing solutions. Although the phrase medication container concealment system is used herein, it is understood that the medication container concealment system may also include a tracking system.

Specifically, the present disclosure provides a medication container information concealment system that includes a privacy label including a first side and a second side, a backing, and a tabular insert. The backing is configured to be peeled off of the second side and is detachably adhered to the second side. The tabular insert is detachably coupled to the second side via a perforated tab. The tabular insert includes tracking information. In response to a peeling off of the backing from the second side, an entirety of the second side is configured to wrap around and permanently affix to an outer surface of a container. The privacy label is configured to conceal information remaining on the outer surface of the container, leaving a portion of the first side exposed outwardly.

Figure 1:
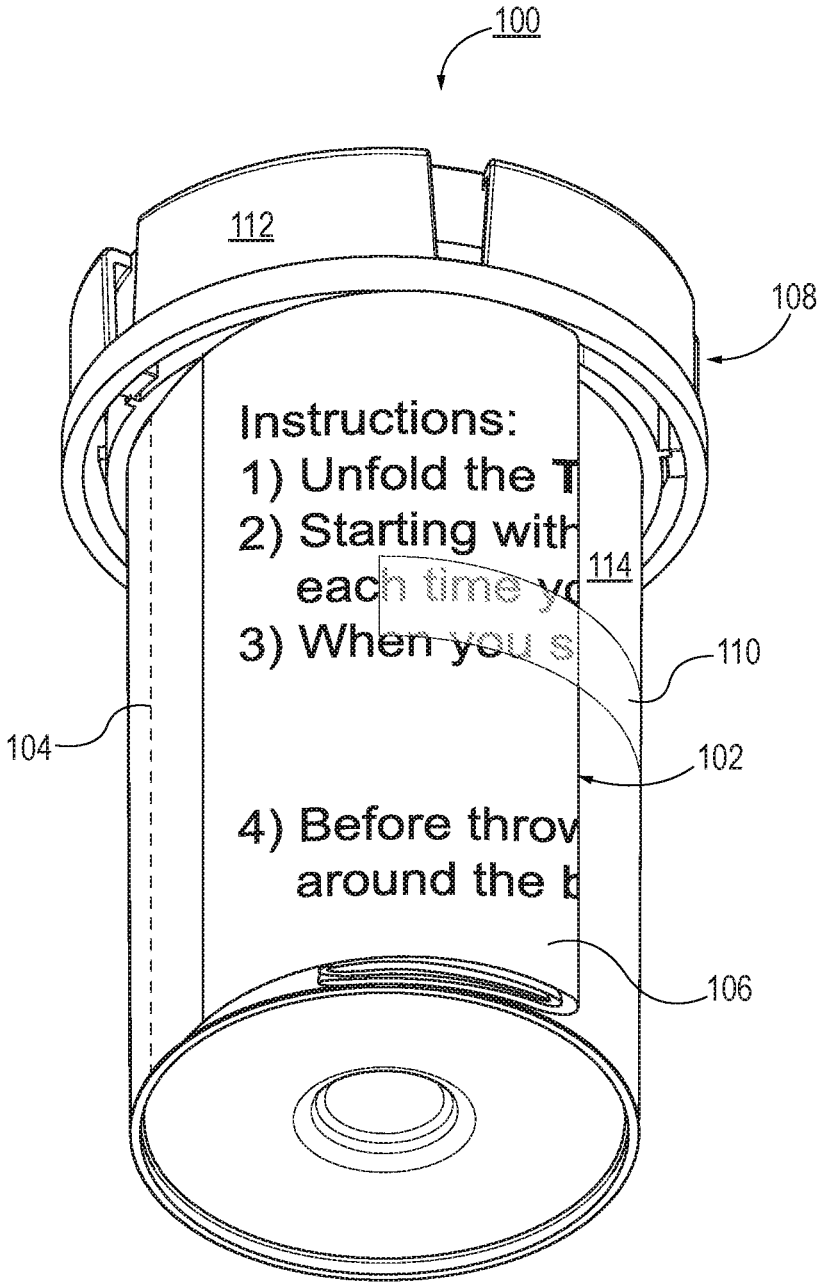
FIG. 1 depicts a perspective view of an enfolded medication container information concealment system for a container, according to an implementation of the present disclosure.

Referring to FIG. 1, a perspective view of an enfolded medication container information concealment system 100 for a container 108 is depicted. Container 108 may be a prescription medication container (as depicted) or another container that contains private information. Container 108 includes a lid 112 and a body 114. An outer surface of body 114 (also referred to herein as an outer surface of the container) may include an affixed prescription label that includes private information (e.g., as shown in FIG. 6).

Referring now to FIG. 6, a prescription label 600 may include information divided into three portions; a heading 602, a body 604, and a closure 606. Other information may also be included. Private information may include a patient's name, patient's address, patient's phone number, patient's date of birth, patient's age, patient's allergies, patient's medical condition, prescription medication name, prescription medication dosage, quantity of medication to be dispensed, number of refills remaining, if generic substitution is allowed, a U.S. Drug Enforcement Administration (DEA) number, prescribing doctor's name, prescribing doctor's address, prescribing doctor's telephone number, pharmacy's name, pharmacy's address, pharmacy's phone number, and/or other information which may be private or personal to a user.

In an implementation, prescription label 600 may be affixed to container 108 via a strong adhesive that may prevent or cause difficulties in removal of prescription label 600 from container 108. Prescription label 600 may be laminated or otherwise coated.

Referring again to FIG. 1, medication container information concealment system 100 includes a privacy label 102 and a tab 104. Tab 104 is depicted as a perforated tab, however, in other implementations, privacy label 102 may be permanently affixed to container 108, with or without a tab. In an implementation, the dashed lines depicted on tab 104 may be decorative. In another implementation, the dashed lines depicted on tab 104 may be representative of perforations. Although medication container information concealment system 100 is depicted as being placed on top of container 108, it is understood that container 108 may or may not be a part of medication container information concealment system 100.

Figure 5:
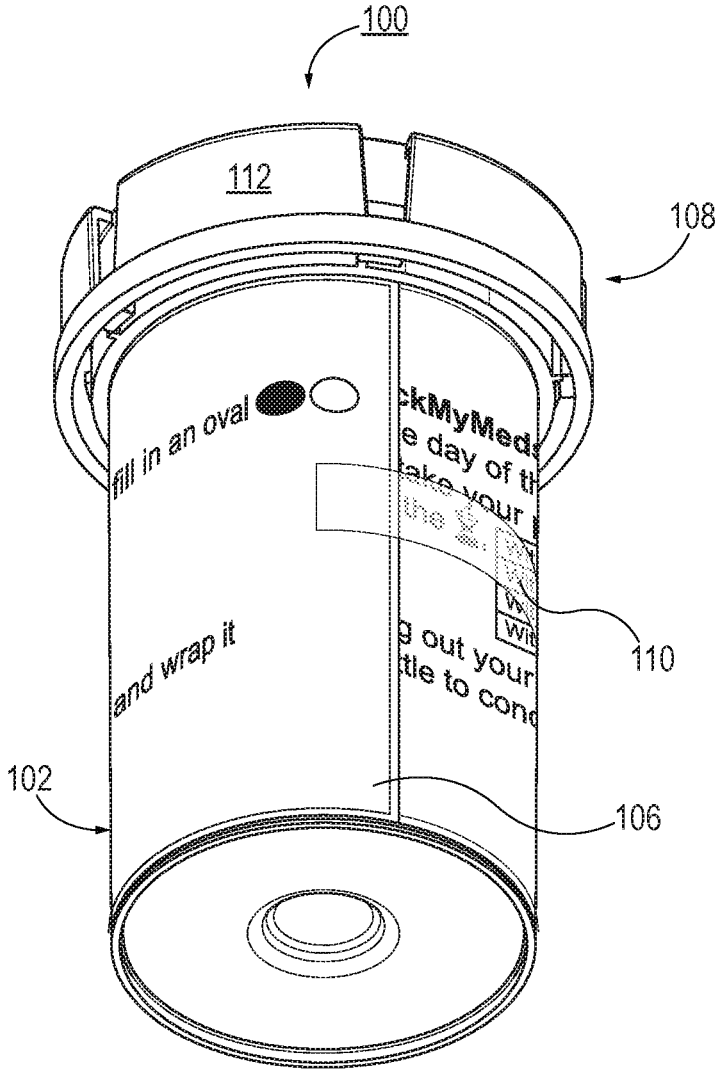
FIG. 5 depicts a perspective view of a medication container information concealment system, in which the privacy label is wrapped around and encompassing the entirety of, or most of, an outer surface of a container, according to an implementation of the present disclosure.

Privacy label 102 (as well as one or more inserts) may be enfolded initially to prevent accidental damaging or tearing of privacy label 102. An optional adhesive tape 110 may be included to secure the folded privacy label 102 to container 108, as depicted in FIGS. 1 and 5. In an implementation, adhesive tape 110 may be reusable/reattachable.

In other implementations, privacy label 102 may not be enfolded initially, or may be enfolded in other variations (not depicted).

In an implementation, privacy label 102 is constructed of a material that deters tampering. For example, privacy label 102 may be constructed of paper, plastic, laminate, waterproof material, or a combination of materials, that, once affixed to container 108 (in a manner described below), may not be removed, scratched off, peeled off, removed by applying a liquid and/or acid, etc. Privacy label 102 may also be opaque and/or contain a dark background, as to not allow for the viewing of information through or under the affixed privacy label when it wraps around a perimeter of container 108 and thus entirely conceals private information contained on container 108 (e.g. privacy information contained on prescription label 600 affixed to container 108 or elsewhere).

Figure 4:
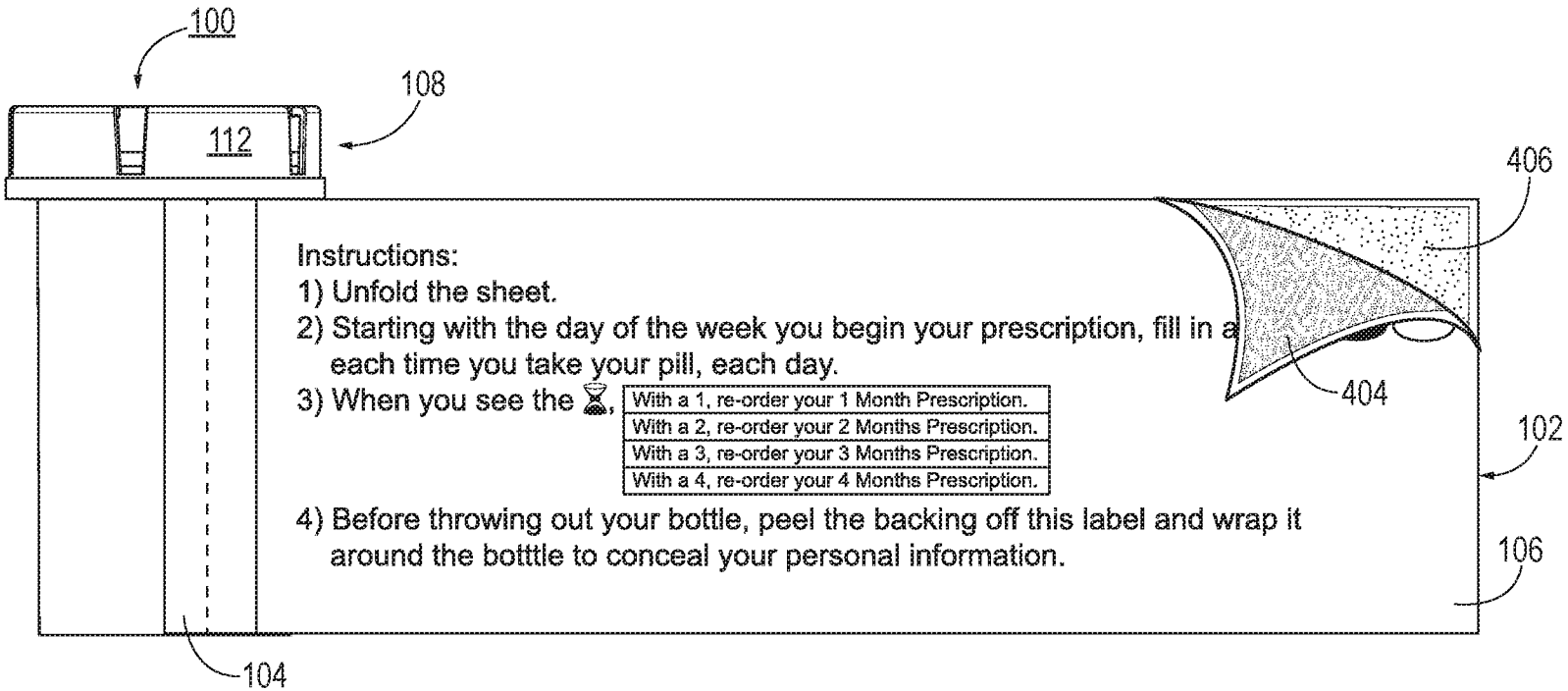
FIG. 4 depicts the privacy label actuated fully outward from the container, according to an implementation of the present disclosure.

Privacy label 102 includes a first side 106 (which faces outwards towards the user viewing container 108) and a second side (see 404 of FIG. 4 which depicts second side 404 which faces away from the user). Medication container information concealment system 100 further includes a backing (see 406 of FIG. 4) which is detachably adhered to second side 404. Backing 406 may be peeled off of second side 404.

Figure 2:
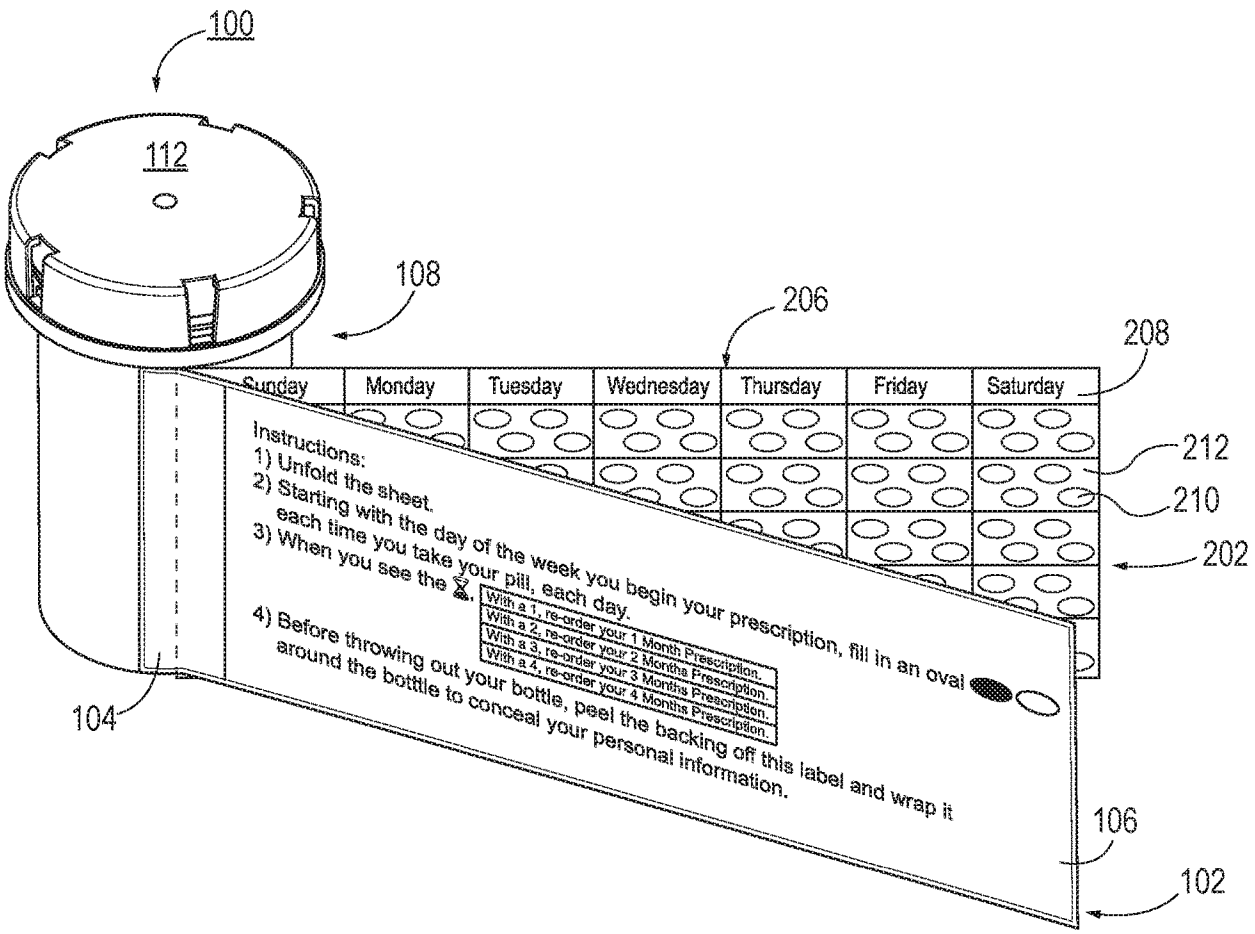
FIG. 2 depicts a front perspective view of an actuation of the privacy label and an adjacent tabular insert, according to an implementation of the present disclosure.

Privacy label 102 is affixed to container 108, via tab 104. Tab 104 may be adhered onto container 108 after a pharmacist fills container 108 with a medication and attaches a prescription label that contains private information. In other implementations, tab 104 and/or privacy label 102 may be a part of or otherwise connected to the label containing private information that is attached thereto container 108. Privacy label 102 may be unfolded/unwrapped and stretched outward, as depicted in FIG. 2.

Backing 406 may be temporarily attached (via an adhesive or via other means) to second side 404 of privacy label 102. Once privacy label 102 is unfolded/unwrapped, second side 404 of privacy label 102 may be peeled off backing 406. In response to peeling off of backing 406 from second side 404 of privacy label 102 (e.g., when a user wishes to dispose of container 108 and permanently conceal private information), an entirety of second side 404 is configured to wrap around and permanently affix to an outer surface of container 108. The user may wrap privacy label 102 around the circumference of the entirety, or most of, the outer surface of container 108. Via an adhesive applied to second side 404, privacy label 102 may then be permanently affixed to container 108 and thus conceal private information remaining on the outer surface of container 108, leaving a portion of first side 106 exposed outwardly, as depicted in FIG. 5.

In an implementation, privacy label 102 when wrapped around container 108, may conceal private information contained on prescription label 600 and/or elsewhere on container 108. Therefore, it is understood that when privacy label 102 is described as wrapping around container 108, privacy label 102 may be wrapped on top of prescription label 600 and/or other portions of or labels affixed to container 108.

In an implementation, a length of privacy label 102 may be longer than a circumference of container 108. Privacy label 102 may be wrapped multiple times or more than once in a way that it overlaps itself (i.e., second side 404 overlaps first side 106). In such an implementation, in response to detaching backing 406 from second side 404, second side 404 is configured to wrap multiple times (or, more than one time) around container 108, such that a portion of second side 404 permanently adheres to a portion of first side 106 (where second side 404 overlaps at least a portion of first side 106). Second side 404 may adhere to all or most of the outer surface of container 108. In another implementation, a length of privacy label 102 may or may not be an exact length of container 108, such that it does not overlap itself. Therefore, in such an implementation, privacy label 102 may not need to be wrapped multiple times around container 108 to cover and conceal private information.

Privacy label 102 may be affixed thereto container 108 in a permanent manner, thereby preventing viewing of private information. A user may not thus tamper with or undo the affixation of privacy label 102.

Figure 3:
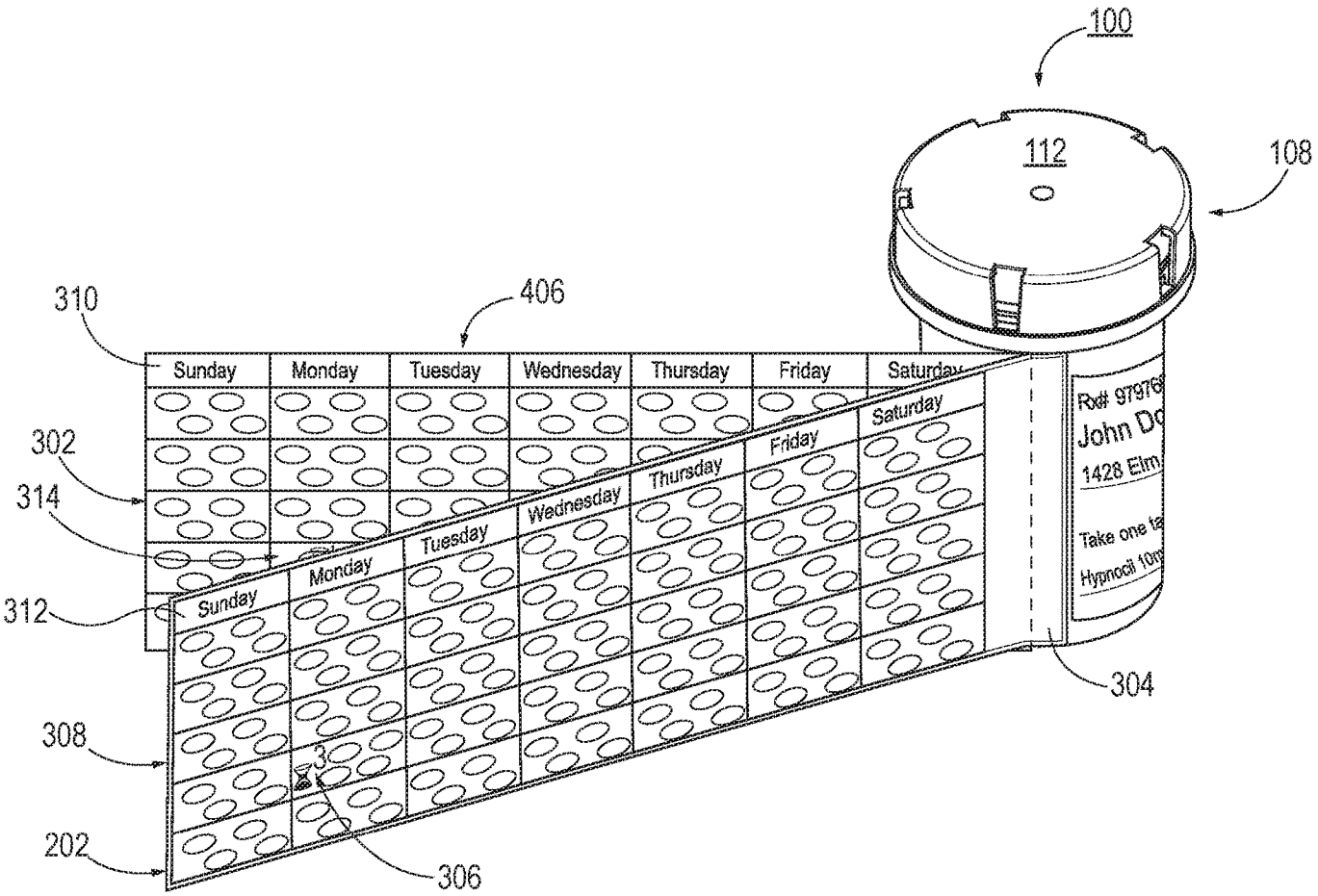
FIG. 3 depicts a back perspective view of an actuation of the backing adhered to the privacy label and an adjacent tabular insert, according to an implementation of the present disclosure.

Medication container information concealment system 100 may further include one or more inserts detachably coupled to privacy label 102 via respective perforated tabs. FIGS. 2 and 3 depict one such insert. A tabular insert 202 is detachably coupled to second side 404 via a perforated tab 304 (as shown in FIG. 3). Tabular insert 202 includes tracking information, as described herein below.

Suppose that a user wishes to use medication container information concealment system 100 to track his/her medication use. The user may remove tape 110, as depicted in FIG. 1, and unfold privacy label 102, as depicted in FIG. 2. FIG. 2 depicts a front perspective view of an actuation of privacy label 102 and an adjacent tabular insert 202. Tabular insert 202 includes tracking information 206. Tracking information 206 may include a calendar 208 and/or a re-ordering reminder system 306 (not viewable in FIG. 2 but depicted in FIG. 3). Calendar 208 is depicted as displaying 35 days, so that a user may track medication use for any calendar month. A column represents a day of a week (e.g., Sunday, Monday, Tuesday, etc.) and a row represents a week of a month (e.g., first week, second week, etc.). A cell 212 represents a specific day in a month. Cell 212 includes one or more ovals 210 which can be utilized by a user to keep track of medication intake and usage. In an implementation, calendar 208 may be tabulated into a week, a month, or many months. Thus, calendar 208 may include a different scheme (e.g., to track medication use weekly, annually, etc.) than depicted. Cells of the tabulated calendar may be also divided by time periods, such as, but not limited to, mornings, afternoons, or evenings, or by exact times (e.g., 3:00 pm, etc.).

Calendar 208 may be utilized to track medication intake and/or use, as described above. For example, in order to use tracking information 206 and calendar 208 to track medication use, the user may assign a cell of a corresponding day and a first row of calendar 208 as a first day of intake of the medication. The user may mark (e.g., with a pen, a marker, a sticker, etc.) an oval (such as oval 210) in a cell of a corresponding day of a week as the user removes medication from container 108 and consumes it. The ovals may represent a quantity of medication to be administered, a time of a day, such as morning, afternoon, or evening, or exact times the medication is to be consumed. The user may mark a number of ovals accordingly. For example, the user may mark one oval in one cell each time the user consumes a medication during a particular day or the user may mark per dosage of medication.

When a row is completely marked, the user may move to a next row of calendar 208. The user may mark ovals on calendar 208 until calendar 208 is completely marked, or there is no more medication remaining in container 108. When all the rows of calendar 208 are marked, the user may use a new sheet of tracking information to continue to track medication use.

Tabular insert 202 is detachably coupled to second side 404 of privacy label 102 via a perforated tab 304 (depicted in FIG. 3). Perforated tab 304 may connect to second side 404 as well as to tab 104. When a user wishes to dispose of tabular insert 202 (e.g., when the user finishes tracking his/her medication use for two-months by utilizing the front side (first side) and/or three months by utilizing the front side and the rear side (second side) of tabular insert 202), the user may detach tabular insert 202 by pulling it apart from perforated tab 304. The user may detach tabular insert 202 from perforated tab 304 along the perforation, which is depicted as dashed lines. In another implementation (not depicted), the user may detach tabular insert 202 by completing pulling it off privacy label 102. The width of the perforated tabs may vary.

In an implementation, the perforated tabs (tab 104 and/or perforated tab 304) may be affixed to container 108 and/or to privacy label 102.

Suppose that a user consumes all the medication contained in his/her medication container. After ripping off or otherwise detaching any attached tabular inserts, the user may then wish to conceal his/her private information that is contained on the container and discard the container in an efficient manner. Before discarding container 108, the user may unwrap privacy label 102 and may remove any remaining adjacent tabular inserts. When the user is ready to conceal the private information contained on container 108 (e.g., imprinted on prescription label 600 or contained elsewhere on container 108), privacy label 102 may be unwrapped or it may be enfolded, as depicted in FIG. 1. The user may then peel backing 406 away from second side 404 of privacy label 102, where the exposed second side 404 contains an adhesive. The user may then hold an edge of privacy label 102 (i.e., the top, right edge as shown in FIG. 4, and wrap privacy label 102 around the circumference of all or most of an outer surface of container 108 (e.g., by affixing second side 404 of privacy label 102 to container 108 itself or a prescription label that may be affixed to container 108, and/or to a portion of first side 106 of privacy label 102). As depicted in the figures, the user may rotate container 108 and/or privacy label 102 in a clockwise direction in order to affix privacy label 102 onto container 108. The resulting affixed privacy label is shown in FIG. 5. Optionally, the user may then re-adhere adhesive tape 110 back onto a portion of privacy label 102.

In other implementations, container 108 and/or privacy label 102 may be rotated in a counter-clockwise direction to affix privacy label 102 onto container 108. In such implementations (not depicted), the resulting exposed privacy label 102 covering container 108 may be blank, or may include any graphics, text, pattern, print, etc.

In an implementation, a length of privacy label 102 is longer than a length of tabular insert 202. In other implementations, these lengths may vary. In an implementation, the length of privacy label 102 is longer than a circumference of container 108. This ensures that the private information can be aptly concealed by privacy label 102. In another implementation, the length of privacy label 102 may vary.

Tracking information 206 may be imprinted on one side or both sides of tabular insert 202 (or other tabular inserts, not depicted) and may be imprinted on first side 106 of privacy label 102 as well as the backside (the side which is not adhered to second side 404) of backing 406 (depicted in FIG. 3).

FIG. 3 depicts a back perspective view of an actuation of backing 406 adhered to privacy label 102 and the adjacent tabular insert 202. Backing 406 (adhered to second side 404 of privacy label 102) and tabular insert 202 further include tracking information 302, and tracking information 308, respectively. Tracking information 302 and tracking information 308 include calendar 310 and calendar 312, respectively. Tracking information 302 and tracking information 308 may include substantially similar information as tracking information 206 of FIG. 2, and the description above with respect to tracking information 206 is applicable to tracking information 302 and tracking information 308.

Additionally, tracking information 308 includes a re-ordering reminder system 306. In the depicted implementation, re-ordering reminder system 306 is an hour-glass symbol marked on calendar 312 of tracking information 308 to remind a user when to re-order the next prescription refill. As a user is marking medication usage (by filling out ovals, as described above), the user may be reminded to re-order the medication via re-ordering reminder system 306. For example, if a user is marking medication usage and re-ordering reminder system 306 appears in a cell for the current day's medication (or in a cell in close proximity to the current day's cell), the user is reminded to place a refill order for the medication. Thus, re-ordering reminder system 306 indicates that the medication is almost finished (e.g., a certain amount of medication, such as one week's supply, remains before the medication is depleted) and the user is reminded to re-order the medication.

Re-ordering reminder system 306 may include a numeral representation (i.e., may be accompanied by a number). The number may indicate the quantity of a medication that should be filled when re-ordering. For example, when the hour-glass symbol of re-ordering reminder system 306 includes a "1", it may be an indication that a one-month supply of medication needs to be refilled. The hour-glass symbol with a "1" (not viewable in FIG. 3) may be placed within a cell 314. When the hour-glass symbol of re-ordering reminder system 306 includes a "2", it may be an indication that a two-month supply of medication needs to be refilled, and so on. As depicted, re-ordering reminder system 306 includes the hour-glass symbol with a "3" to indicate that a three-month supply of medication needs to be refilled. In an implementation, a user would utilize tracking information 302 to track medication on backing 406, followed by tracking medication on a first side of tabular insert 202, and then on a second side of tabular insert 202 (where the hour-glass symbol with a "3" is depicted in FIG. 3). When all medication has been consumed, the user may peel backing 406 and wrap privacy label 102 around container 108, as described in a manner above.

In an implementation, re-ordering reminder system 306 may be preset (i.e., pre-printed) and be located in the same place for multiple medication container information concealment systems. In another implementation, re-ordering reminder system 306 may be imprinted on to tracking information at the time a pharmacist fills a container with medication (and thus, may be customized to a user and/or to a particular medication).

In an implementation, re-ordering reminder system 306 may be marked on one or more (and on one or more sides) of the tabular inserts or privacy label 102. In an implementation, re-ordering reminder system 306 may be represented by any other symbol and/or text.

In an implementation, calendar 208 may be formatted in a universal way (i.e., left blank) so that it may be used by any patient to track medication use. In another implementation, calendar 208 may be customized (i.e., contain customized text, symbols, etc.) to match the exact days or dates that the patient is to use the medication. Re-ordering reminder system 306 and cells may also be customized to a specific medication and dosage. Additionally, the number of tabular inserts included may be universal or customized to a specific medication and dosage.

As described above, backing 406 includes tracking information 302. Tracking information 302 includes calendar 310 to track medication use and/or re-ordering reminder system 306 to remind a user when to re-order medication. In an implementation, a user may track information on both sides of tabular insert 202 first and then on backing 406 after. This would allow the user to detach tabular insert 202 when tracking information 302 is filled. Thus, when tabular insert 202 is detached from perforated tab 304, tracking information 302 may remain and be used to remind the user when to re-order his/her next prescription container. When all medication has been consumed, the user may peel backing 406 and wrap privacy label 102 around container 108 to conceal private information, as described in a manner above.

Referring now to FIG. 3, the user may use tracking information 302 or tracking information 308 when needed. The user may continue marking the medication use on tracking information 302 or tracking information 308 until all cells are completely marked or the medication is depleted.

In an implementation, any tabular inserts may vary in size from privacy label 102. For example, tabular insert(s) may be shorter and/or narrower in size than privacy label 102, which would ensure that privacy label 102 can adhere to itself or to container 108. In yet another implementation, tabular insert(s) may be the same size as one another and/or the same size as privacy label 102.

In an implementation, medication container information concealment system 100 may include more or less tabular inserts than depicted. In an implementation (not depicted), medication container information concealment system 100 may include two tabular inserts (a first tabular insert and a second tabular insert) adjacent one another. Suppose that the first tabular insert is located sandwiched in between the second tabular insert and privacy label 102. When unwrapped, the privacy label would lay next to the first tabular insert, and the first tabular insert would lay next to the second tabular insert; all inserts and the privacy label would be arranged accordion style. The first tabular insert may be detachably coupled to a first perforated tab. The second tabular insert may be detachably coupled to a second perforated tab. The second tabular insert may be coupled to either one of second side 404 of privacy label 102 or tab 104 via the second perforated tab. In another implementation, the second tabular insert may be coupled to perforated tab 304. When the first tabular insert is detached from the first perforated tab, the second tabular insert then becomes adjacent second side 404.

For example, when the calendar(s) in the first tabular insert is/are completely marked, the first tabular insert may be detached from the first perforated tab, leaving the second tabular insert adjacent to second side 404 of privacy label 102. Such an arrangement may allow for the prevention of clutter and confusion. If additional tabular inserts are included, a user may similarly detach tabular inserts until no tabular inserts remain. If additional tabular inserts remain, however, and no medication remains in the container, the user may remove (e.g., detach, rip off, etc.) each of the remaining inserts from respective perforated tabs prior to wrapping the privacy label around the circumference of the container to conceal private information.

In an implementation, the first tabular insert and/or the second tabular insert may maintain, on one side or both sides, tracking information that includes a calendar and/or a re-ordering reminder system. In an implementation, tracking information included on the first tabular insert may be initial tracking information (to be filled out first), and the second side may include continued tracking information (to be filled out after the initial tracking information is completely filled). In another implementation, initial tracking information may instead be included on the backing (as depicted in the FIG. 3). In an implementation, each of the initial tracking information and the continued tracking information is organized in a tabular format. The tabular format may include rows and columns, such as in a monthly calendar.

In an implementation, after the inserts have been completely marked, the user may then continue to track medication usage, if needed and if medication remains, on backing 406.

FIG. 4 depicts privacy label 102 actuated fully outward and unwrapped from container 108, depicting the peel-back nature of backing 406. As depicted, backing 406 is detachably adhered to and may be peeled off from second side 404 of privacy label 102. Backing 406 is constructed of a material that does not permanently adhere to the second side 404. Thus, backing 406 is made of a material that is easily and cleanly detachable from the adhesive second side 404. Backing 406 may be constructed of glossy paper, or other material. A user may remove backing 406 from the second side 404 to expose an adhesive which has been applied to second side 404.

In an implementation, an adhesive applied to second side 404 may have adequate strength so that it may not be peeled off of container 108 (or a prescription label attached to container 108). The adhesive may be applied in any pattern on second side 404 such that privacy label 102 may be tamper-proof when adhered to container 108.

In the depicted implementation, first side 106 of privacy label 102 includes instructions for using medication container information concealment system 100. In other implementations, other text, graphics, symbols, and/or other information may be provided on first side 106. In yet another implementation, first side 106 may be blank (free of text, graphics, symbols, and/or other information), patterned, or solid and may be colored or white.

FIG. 5 depicts a perspective view of medication container information concealment system 100, in which privacy label 102 is wrapped around and encompasses the entirety of, or most of, an outer surface of container 108. As depicted in FIG. 5, privacy label 102 is wrapped around and affixed permanently to container 108 and portions of the first side 106, concealing private information. After privacy label 102 is wrapped around container 108, a user may dispose of the medication container information concealment system 100 encompassing container 108 without having to worry about compromising his/her private information.

Although a medication container information concealment system and a medication tracking system is described for a prescription medication container, the concealment system and/or tracking system may be utilized by any container. Furthermore, a size and shape of the container may vary. For example, if a container is shaped similar to a cube, the privacy label may permanently adhere to the cube in a similar manner as described above with respect to the container 108.

In the figures, which may not be drawn to scale, like numerals refer to like features throughout the description.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Reference throughout this specification to "an implementation" or "one implementation" means that a particular feature, structure, or characteristic described in connection with the implementation is included in at least one implementation. Thus, the appearances of the phrase "an implementation" or "one implementation" in various places throughout this specification are not necessarily all referring to the same implementation.

It is to be understood that the above description is intended to be illustrative, and not restrictive. Many other implementations will be apparent to those of skill in the art upon reading and understanding the above description.

What is claimed is:

1. A tamper deterrent medication container information concealment system comprising:

a prescription medication container comprising a body, the prescription medication container having a circumference;

a prescription label affixed to an outer surface of the body of the prescription medication container, the prescription label providing private information;

a privacy label comprising a first side and a second side, the privacy label constructed of a material comprising at least one of plastic or waterproof material, wherein the material deters tampering of the private information, wherein a length of the privacy label is longer than twice the circumference of the prescription medication container;

an adhesive is applied to an entirety of the second side; and a backing, configured to be peeled off of the second side, detachably adhered to the second side, wherein the adhesive is applied between the second side and the backing; and a tab of the privacy label permanently adhered to a first portion of the prescription label;

wherein in response to a user peeling off the backing from the second side, the user permanently affixing the second side, via the adhesive, to:

a second portion of the prescription label, and a first portion of the first side, by wrapping, in a clockwise or counter-clockwise direction, an entirety of the second side of the privacy label around the second portion of the prescription label and the first portion of the first side to conceal the private information provided on the prescription label, leaving a second portion of the first side exposed outwardly, wherein a length of the first side adhered to the second side is longer than the circumference of the prescription medication container; and wherein the first side maintains tracking information comprising a re-ordering reminder system comprising a symbol marked on a calendar to remind a user when to re-order medication.

2. The medication container information concealment system of claim 1, wherein the backing maintains additional tracking information.

3. The tamper deterrent medication container information concealment system of claim 2 wherein the additional tracking information comprises at least one of an additional calendar or an additional re-ordering reminder system.

4. The tamper deterrent medication container information concealment system of claim 1, wherein the re-ordering reminder system comprises a numeral representation.

5. A tamper deterrent medication container information concealment and medication tracking system comprising:

a prescription medication container having a circumference;

a prescription label affixed to an outer surface of the prescription medication container, the prescription label providing private information;

a privacy label constructed of a material comprising at least one of plastic, or waterproof material, wherein the material deters tampering of the private information, wherein a length of the privacy label is longer than twice the circumference of the prescription medication container, the privacy label comprising:

a first side; and a second side, wherein an adhesive is applied to an entirety of the second side;

a backing, configured to be peeled off of the second side, detachably adhered to the second side, wherein the adhesive is applied between the second side and the backing;

a tab of the privacy label permanently adhered to a first portion of a prescription label;

wherein in response to a user peeling off the backing from the second side, the user permanently affixing the second side, via the adhesive, to:

a second portion of the prescription label, and a first portion of the first side, by wrapping, in a clockwise or counter-clockwise direction, an entirety of the second side of the privacy label around the second portion of the prescription label and the first portion of the first side to conceal the private information provided on the prescription label, leaving a second portion of the first side exposed outwardly, wherein a length of the first side adhered to the second side is longer than the circumference of the prescription medication container; and wherein the first side maintains tracking information comprising a re-ordering reminder system comprising a symbol marked on a calendar to remind a user when to re-order medication.

6. The tamper deterrent medication container information concealment and medication tracking system of claim 5, wherein instructions are imprinted on the first side.

7. The tamper deterrent medication container information concealment and medication tracking system of claim 5, wherein the backing comprises additional tracking information, and wherein the additional tracking information comprises at least one of an additional calendar to track medication use or an additional re-ordering reminder system to remind a user when to re-order medication.

* * * * *